United States Patent [19]

Busler

[11] 4,118,859

[45] Oct. 10, 1978

[54] PACKAGING AND ASSEMBLY OF SHEET METAL PARTS

[75] Inventor: Willard Leroy Busler, Harrisburg, Pa.

[73] Assignee: AMP Incorporated, Harrisburg, Pa.

[21] Appl. No.: 746,272

[22] Filed: Dec. 1, 1976

[51] Int. Cl.[2] ..... H01H 11/00

[52] U.S. Cl. ..... 29/622; 206/330; 428/571

[58] Field of Search ..... 29/429, 467, 622, 626, 29/739; 206/328, 329, 330; 428/571

[56] References Cited

U.S. PATENT DOCUMENTS

| | | | |
|---|---|---|---|
| 3,977,522 | 8/1976 | Aker et al. | 206/330 |
| 4,004,688 | 1/1977 | Braden | 206/330 |

*Primary Examiner*—Lowell A. Larson
*Attorney, Agent, or Firm*—Frederick W. Raring

[57] ABSTRACT

Two types of sheet metal parts of an assembly, such as a small electrical switch, are mounted on a continuous strip of easily deformable material in side-by-side alternating relationship so that each part of one type has a part of the other type adjacent thereto on each side. When the parts are assembled to a workpiece, such as a circuit board, the strip is fed to an assembling station to position the leading first part of the strip at the assembly site. The leading first part is assembled to the workpiece and the strip is then indexed to position the leading second part in proper alignment with the workpiece. The second part is then assembled to the workpiece, the strip is again indexed, and the workpiece is repositioned for the next assembly sequence.

10 Claims, 7 Drawing Figures

4
6
8
9
11
12
14
24
26
27
28
42
44
46
48
50
52
54
56
58
60
62
62'
64
64'
66
68
69
69'
70
72
74
75
76
78
80
82
84
86
94

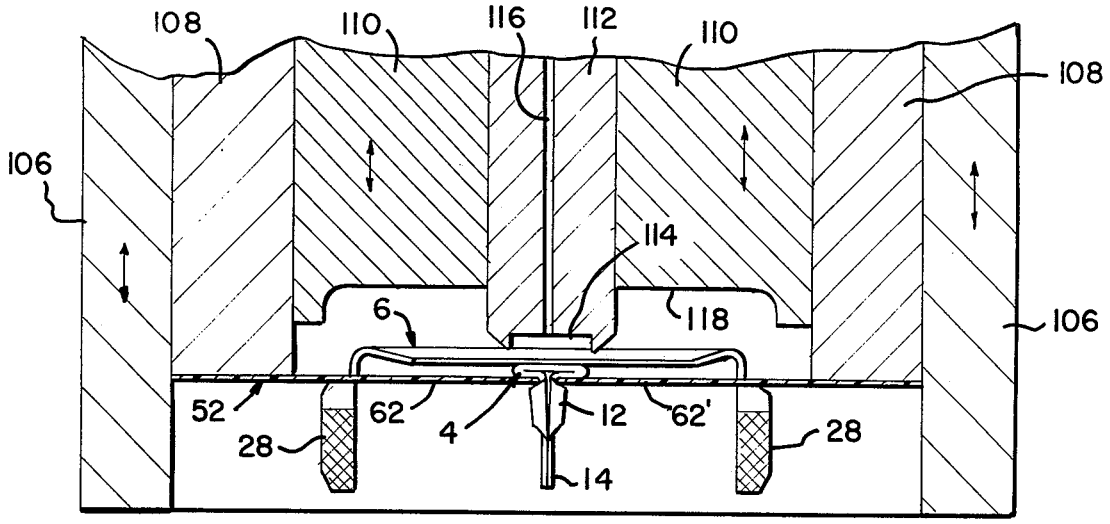
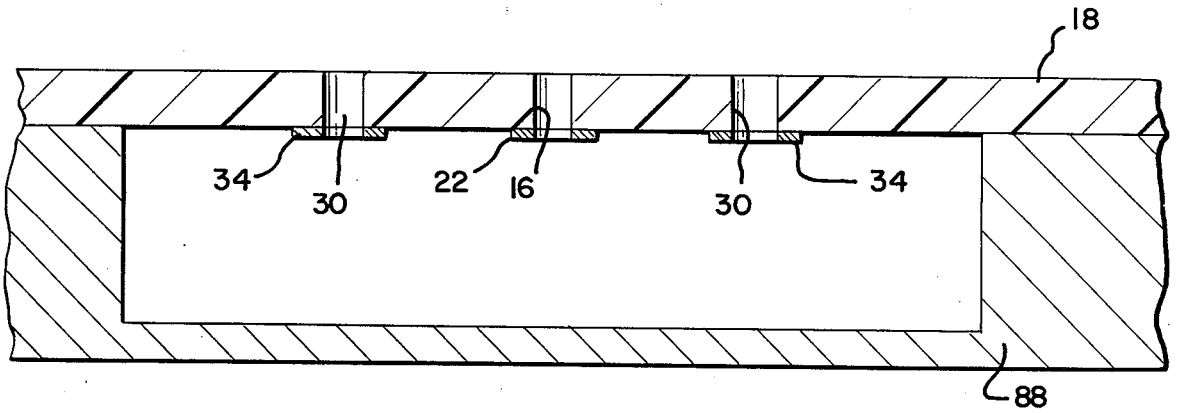
Fig. 4
Fig. 7
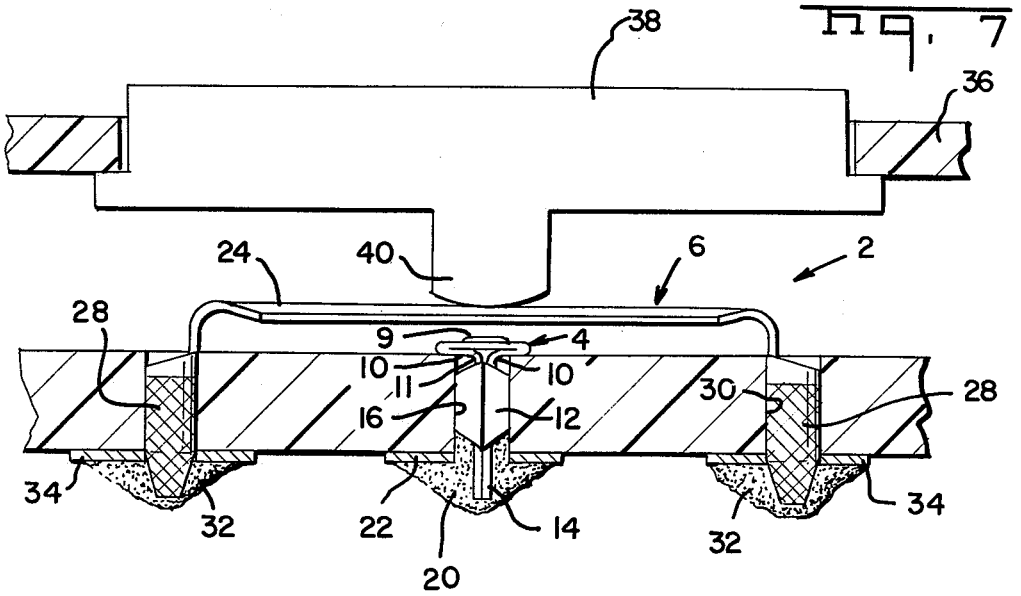

PACKAGING AND ASSEMBLY OF SHEET METAL PARTS

BACKGROUND OF THE INVENTION

This invention relates to the packaging of sheet metal parts and to the assembly of such parts to a workpiece. There herein disclosed embodiment of the invention relates to the packaging of the two parts of a keyboard switch and the assembly of the parts to a circuit board. However, it will be apparent that the principles of the invention can be used for other types of sheet metal parts which are to be assembled to a workpiece.

The widespread and increasing use of circuit boards has given rise to a need for relatively small inexpensive switches which are mounted on the circuit board and which are momentarily closed by an operator. These so called keyboard switches each comprise a fixed contact which is rigidly mounted on the circuit board and a normally open movable spring contact which is spaced from the fixed contact and which can be resiliently moved towards, and into engagement with, the fixed contact when the switch is closed.

It is common practice to manufacture the fixed and movable contacts or keyboard switches from metal strip by stamping and forming operations and it is also common practice to assembly the switch parts to the circuit board in two separate assembly operations. For example, during the manufacture process, the circuit board is carried to a first insertion apparatus at which fixed contacts are inserted into the board at all the locations at which a switch is required. The board is then carried to a second assembly machine at which the spring contacts are assembled to the board adjacent to each of the fixed contacts. It will be apparent that this two step assembly process is relatively costly and time consuming and, in fact, the cost of providing the switches on an inexpensive hand held calculator constitutes an inordinately high percentage of the total manufacturing cost.

The instant invention is directed to the achievement of improved packaging methods which will facilitate, and reduce the assembly cost of keyboard switches for circuit boards. The invention is also directed to the achievement of improved handling and shipping methods for keyboard switch parts, and other small parts, which give rise to other benefits as will be described below.

It is accordingly an object of the invention to provide an improved packaging method for small sheet metal parts. A more specific object is to provide an improved packaging method for the two parts of a keyboard switch. A further object is to provide an improved method of assembling sheet metal parts to a workpiece. A still further object is to provide an improved method of assembling the two parts of a keyboard switch to a circuit board.

These and other objects of the invention are achieved in a preferred embodiment thereof which is briefly described in the foregoing abstract, which is described in detail below, and which is shown in the accompanying drawing in which:

FIG. 3 is a perspective view of an insertion apparatus for removing the switch parts from the carrier strip and inserting them into a circuit board.

FIG. 4 is a view taken along the lines 4—4 of FIG. 3 showing the insertion tooling for inserting the switch parts into the circuit board, this view showing the positions of the parts prior to the beginning of the sequence of steps during which a complete switch is inserted into the circuit board.

Figures 1, 2:
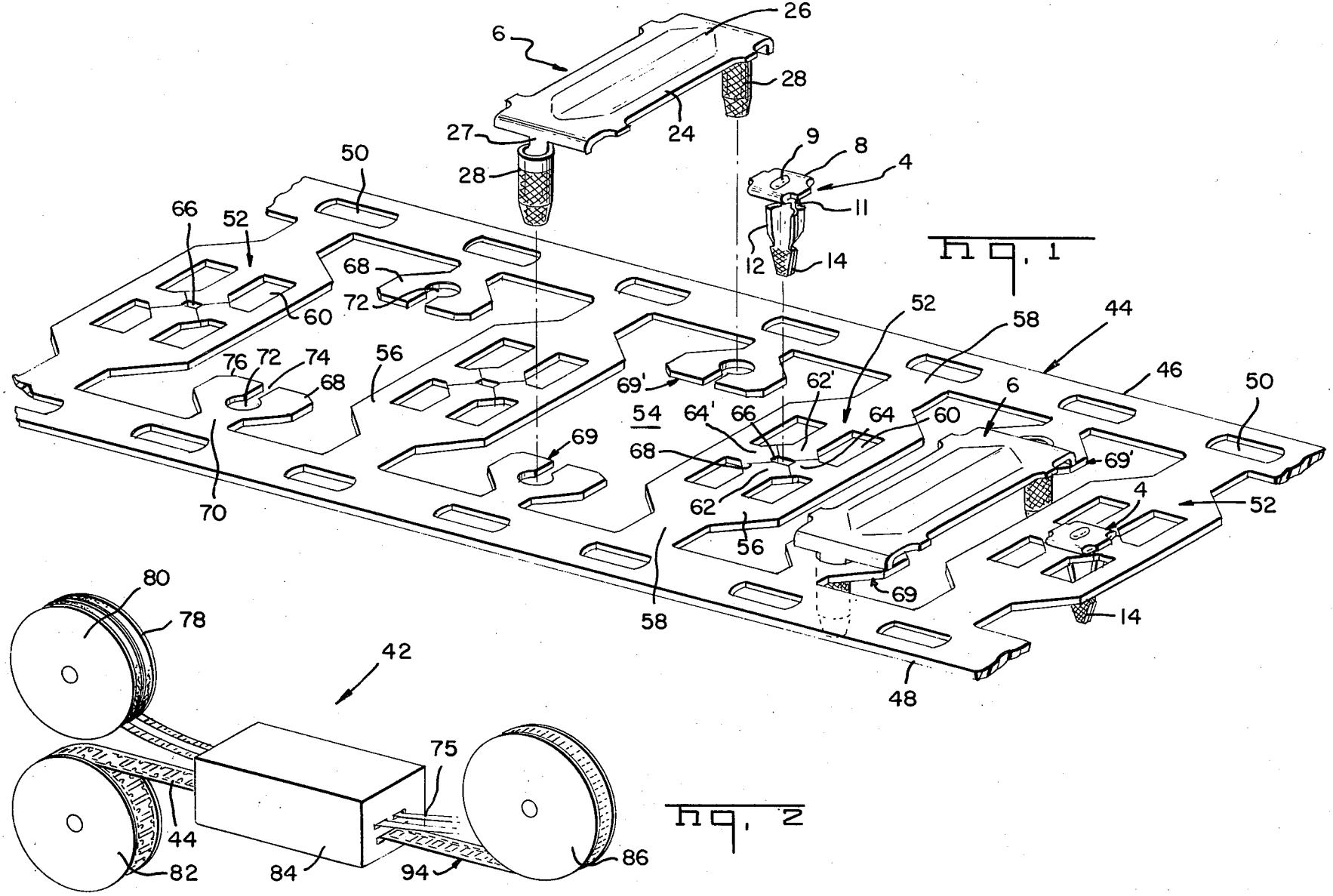
FIG. 1 is a perspective view of a short section of strip in accordance with the invention on which a plurality of switch parts are removably mounted.
FIG. 2 is a perspective view of an apparatus for assembling the switch parts to the carrier strip shown in FIG. 1.

A commonly used type of keyboard switch 2 (FIGS. 1 and 7) for electronic calculators, control circuit boards for appliances, and similiar devices comprises a button-like fixed contact 4 and a movable spring contact 6 which is normally spaced from the fixed contact but which is engaged with the fixed contact when the switch is closed. The fixed contact 4 has a substantially flat plate-like upper end 8 on which a central contact boss 9 is centrally located. Opposite side portions of the plate-like section 8 are reversely folded as shown at 10 and merge with a downwardly extending relatively narrow neck portion 11. The downwardly extending portions which are below the neck 11 have back-to-back semi-cylindrical enlarged mounting portions 12 which are tapered at their lower ends 14 to facilitate the insertion of the fixed contact into a hole 16 in the circuit board 18. The lower end 14 is soldered as shown at 20 to a conductor 22 on the underside of the circuit board 18 by wave soldering or other suitable soldering methods.

Figure 7:
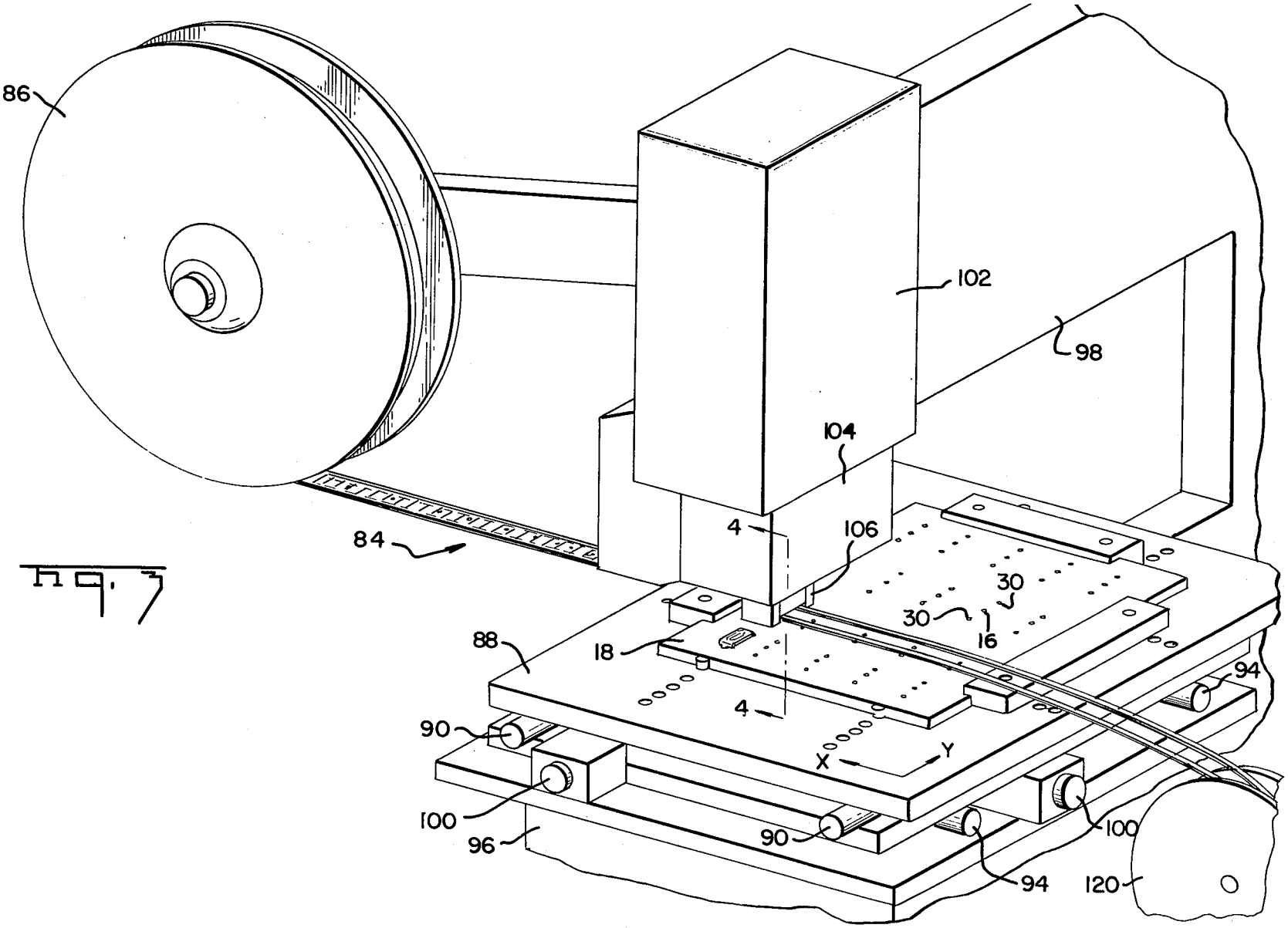
FIG. 7 is a cross sectional view of a keyboard switch on a circuit board and showing the actuating means for the switch.

The spring contact 6 comprises a rectangular plate section 24 having an upwardly formed center portion 26 which can be resiliently deformed downwardly as viewed in FIG. 7 when the switch is closed. Mounting post portions 28 extend downwardly from the opposite ends of the plate-like section 24 and are connected thereto by relatively narrow neck sections 27. In the assembled switch, the mounting post portions 28 are received in spaced-apart holes 30 in the circuit board 18 and are soldered as shown at 32 to conductors 34. The switch is closed by a switch button 38 which is mounted in the housing 36 of the calculator and which has a depending boss 40 which depresses the upwardly formed section 26 when the button is pushed downwardly to complete a circuit extending between the conductor 22 and the conductors 34.

The switch parts 4, 6 are manufactured by die stamping and forming suitable sheet metal strip such as spring temper brass, beryllium copper, or spring steel. The parts are produced by the stamping die as an endless strip and wound on reels 78, 80. The switch parts in the end-to-end strip are then assembled to the carrier strip 44 which is shown in FIG. 1.

The carrier strip 44 may be of any suitable deformable material such as thin steel strip or a suitable plastic material such as Mylar (polyethylene, terephthalate) having a thickness of about 0.008 to 0.010 inches. The strip 44 has parallel side edges 46, 48 and sprocket holes 50 adjacent to its side edges for feeding the strip through an assembly apparatus 42 and through the insertion apparatus 84 described below. A plurality of mounting sites 52 for fixed contacts 4 are provided on the strip and a plurality of mounting site 54 are provided for the spring contact 6, the two types of mounting sites being in alternating order so that each mounting site 52 is located between two mounting sites 54 for spring contacts 6. The mounting sites are formed by die cutting openings in the strip 44 so that the remaining portions of the strip support the contact members 4, 6.

Each mounting site 52 comprises a generally rectangular supporting pad area 56 which is connected to the sides of the carrier strip by integral connecting sections 58. Four openings 60 are provided inthe support pad area 56 and a small central opening 66 is symmetrically located with respect to these four openings 60 on the central axis of the strip. The material of the strip is slit along lines 68 which extend from the central opening 66 to the surrounding openings 60 so that two opposed pairs of cantilever arms 62, 62' and 64, 64' are provided. By virtue of the physical properties of the strip material, a contact member 4 can be assembled to each mounting site 52 by aligning the mounting portion 12, 14 with the opening 66 and moving the contact 4 downwardly as indicated in FIG. 1. The cantilever arms 62, 62' and 64, 64' will flex downwardly during movement of the mounting portion 12 of the contact through the opening 66 until the neck portion 11 of the contact is in the plane of the strip. The arms 62, 62' and 64, 64' will then return to their normal positions and portions of the flat plate-like portion 8 of the contact will extend over the outer ends of the arms. The contact will then be securely, but removably, held on the strip.

Each mounting site 54 is produced by die cutting a generally H-shaped opening in the strip so that inwardly directed support arms 69, 69' remain adjacent to the side edges. Each support arm comprises a relatively narrow neck portion 70 and an enlarged free end portion 68. A circular opening 72 is provided in the enlarged end portion 68 and a narrow slot 74 extends from this circular opening to the free end 76 of each support arm.

An individual spring contact 6 can be assembled to a mounting site 54 by aligning the mounting post portions 28 with the openings 72 and moving the spring contact downwardly from the exploded position of FIG. 1. The support arms 68, 70 will be flexed downwardly and spread apart until the neck portion 27 of each mounting section 28 is disposed in the opening 72. The spring contact 6 will then be held on the strip by virtue of the fact that the end portions of the flat rectangular section 24 will extend over the enlarged ends 68 of the support arms.

The contact members 4, 6 can be assembled to the carrier strip 44 by a suitable assembly apparatus as shown at 42 in FIG. 2. A previously prepared carrier strip 44 is fed through the assembly apparatus and continuous strips of contact members 4, 6 are fed from reels 78, 80 through assembly apparatus in the same direction. The individual contacts 4, 6 are removed from the continuous strips of contacts and inserted into the carrier strip 44 by downward movement of the contacts towards the carrier strips as described above. The carrier strip 44 with the contact members thereon is then wound on a reel 86 which is transported to the insertion apparatus described below and shown in FIG. 3. It is common practice to manufacture sheet metal parts with an integral metal carrier strip from which they are removed in the insertion apparatus. The scrap metal carrier strips emerge from the insertion apparatus as shown at 75.

It should be noted that the strip 44 is wound on the reel 86 in an orientation such that the mounting portions 12, 28 of the contacts are directed radially outwardly with respect to the center of the reel 86. When the strip 44 is wound on the reel in this manner, the flexure of the strip causes the support arms 62, 62', 64, 64' at the sites 52 and the arms at the sites 54 to tighten their grip upon the terminals so that the terminals will not fall from the strip.

Electrical switches 2 which have been packaged on a reel 86 in accordance with the invention can be assembled to a circuit board with relatively simple insertion tools and a fixture means for the circuit board. For example, hand assembly of the switch parts to the circuit board can be carried out by simply providing a holding means for the circuit board 18 and a manually operated holding means for the strip 44 to hold the strip in spaced relationship to the surface of the circuit board. The operator can then manually index the strip to position a fixed contact 4 in alignment with a hole 16. The operator can then push the fixed contact downwardly from the carrier strip and into the circuit board with a simple hand tool. The operator then manually indexes the strip to locate a spring contact 6 above the previously inserted fixed contact and he pushes the spring contact downwardly and into the circuit board by a simple hand held pushing tool. A manual assembly process of this type results in substantial time savings as compared to other manual assembly methods and may prove entirely satisfactory for limited production runs.

For larger production runs, an insertion apparatus of the type shown in FIG. 3 can be used to assemble switches 2 to a circuit board 18. This apparatus 84 has a bracket on which a reel 86 of the strip 44 is mounted and the strip is fed from the reel to an insertion head described below. The apparatus comprises a first plate 88 on which the circuit board is supported and which in turn is supported on guide rods 90 which permit movement of the plate 88 in the direction of the arrow Y in FIG. 3. The guide rods 90 in turn are supported on a plate 92 which in turn is supported slidably on guide rods 94 to permit movement of the plate 88 in the X direction. This X-Y positioning system can be moved manually or can be provided with a suitable control system under the influence of a micro-processor or the like. If an electrical actuating system is used, jog buttons 100 are provided as part of a control system to permit incremental movement of the plate 88 for set-up and adjustement purposes.

The rods 94 are mounted on the lower arm 96 of the frame of the apparatus and a housing 102 is provided on the end of an upper arm 98 for the tooling actuating means. The tooling actuators drive insertion tooling, described below, and may comprise any suitable cam, crank, or pneumatic mechanism.

The tooling is contained in a housing 104 mounted on the lower end of the actuator housing 102 and comprises (FIG. 4) a reciprocable clamping member 106, a reciprocable spring insertion tool 110, and a reciprocable contact insertion tool 112. A fixed guide member 108 extends downwardly from the housing 104 and provides the bearing surface for the clamp 106 and the spring insertion tool 110. The strip 44 is fed and indexed through the apparatus to position the contact members in the insertion zone and beneath the insertion tooling.

Figure 5:
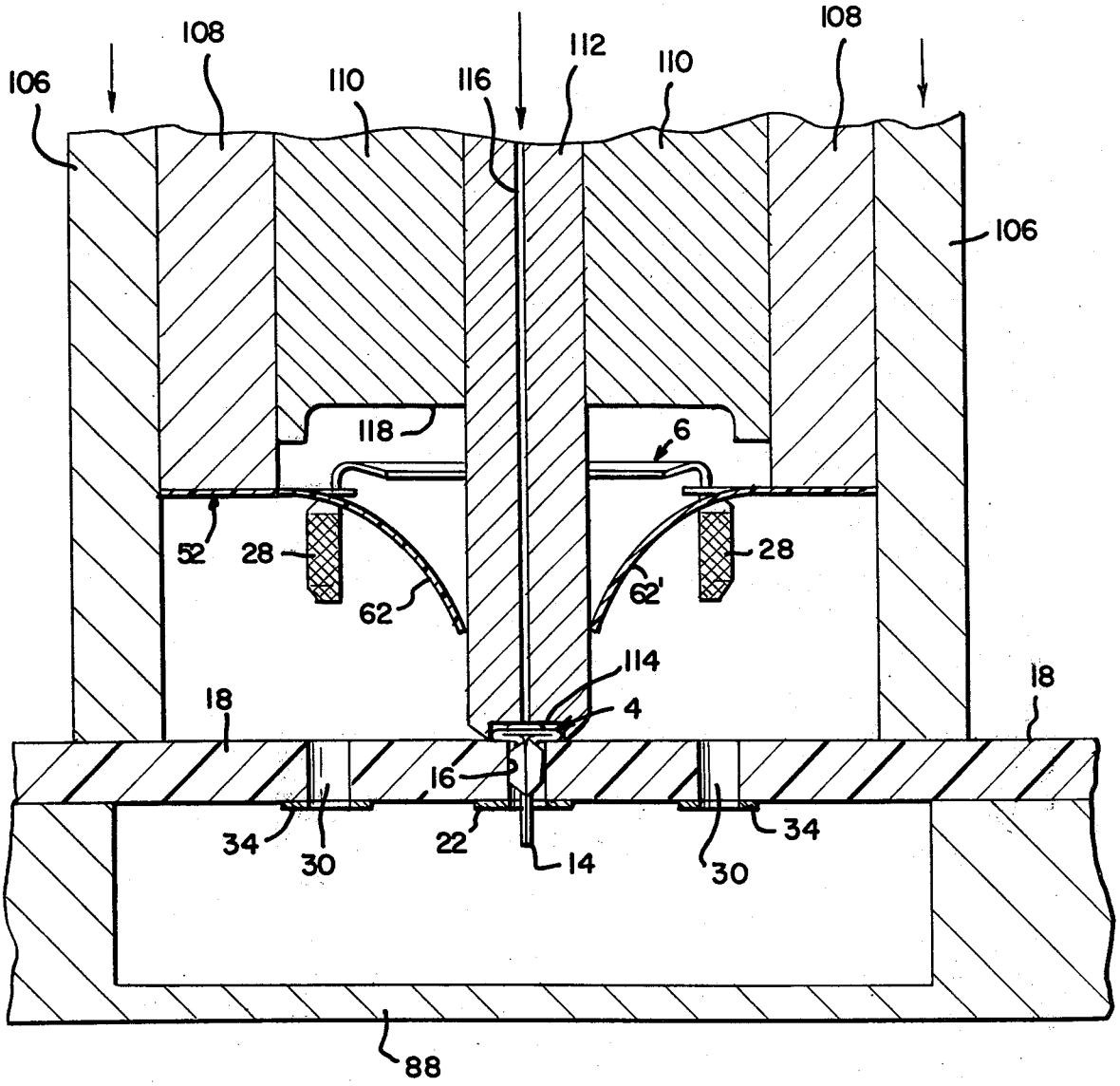
FIGS. 5 and 6 are views similiar to FIG. 4 but showing the positions of the parts at successive stages of the insertion process.
Figure 6:
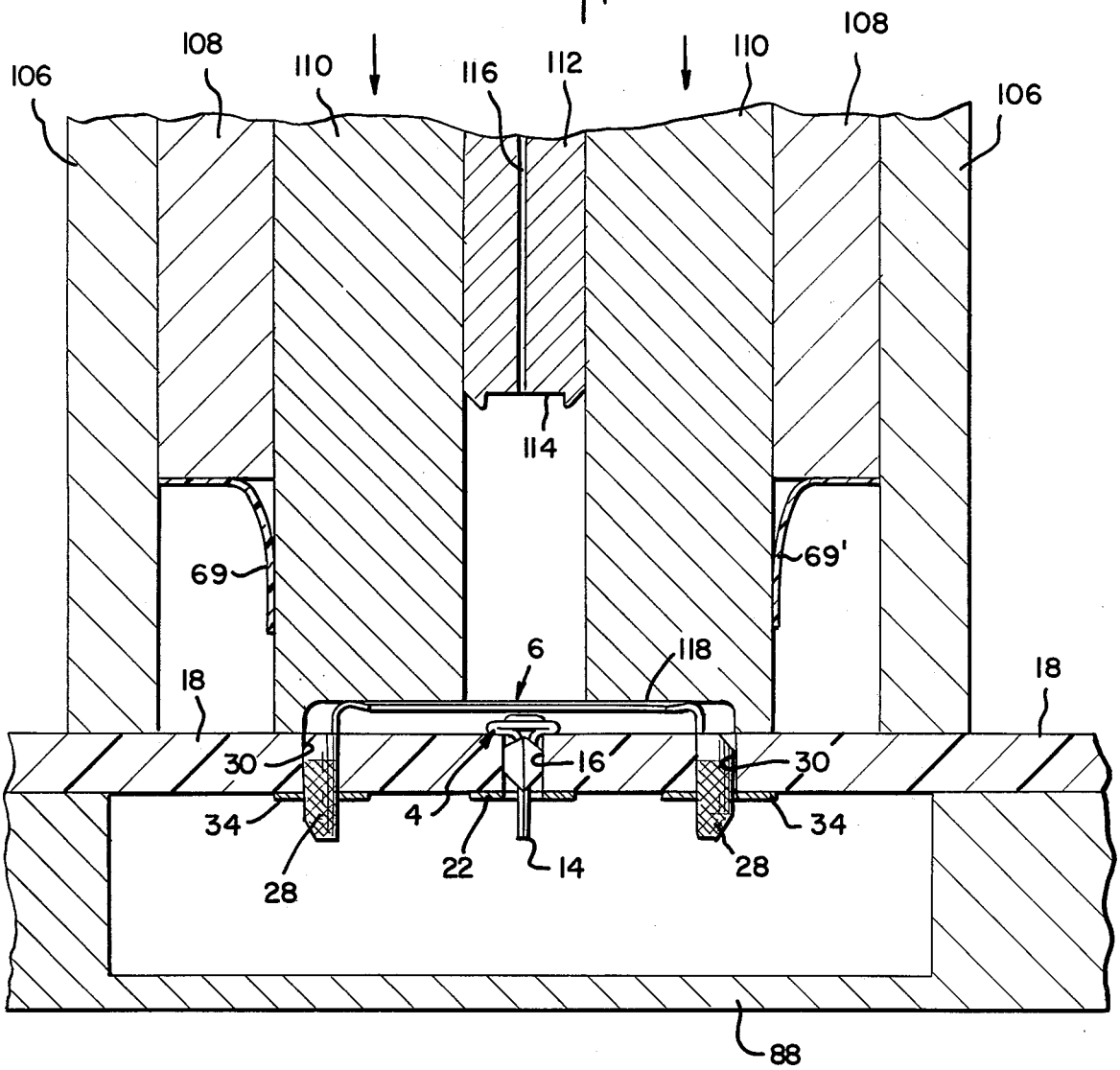

The lower end 118 of the spring insertion tool 110 is dimensioned and contoured to engage the spring contacts 24 and push them downwardly into the circuit board 18 and the lower end of the fixed contact insertion tool 112 is similiarly contoured, as shown at 114, to engage the contact members and push them into the circuit board. A vacuum line 116 is provided in the insertion tool 112 to hold the fixed contact 4 in the recess 114 while it is being pushed into the circuit board and, if desired, similiar vacuum means can be provided in the insertion tool 110. In use, the board 18 is mounted on plate 88 and a site at which a spring is to be provided on the board 18 is located beneath the insertion tooling. The insertion tool 112 and the clamping member 106 are moved downwardly as shown in FIG. 5 to clamp the board and move a fixed contact 4 downwardly and into the opening 16 in the board. As shown in FIG. 5, the cantilever arms 64, 64' and 62, 62' flex downwardly and release the fixed contact 4 from their grip during downward movement of the tool 112. After the insertion tool 112 has been returned to the position of FIG. 4, the strip is indexed to position the adjacent spring contact 6 in the insertion zone and the insertion tool 110 is moved downwardly to insert a spring contact to the board. Again, the cantilever arms 68, 70 are flexed downwardly as they release the spring contact from their grip.

It will be understood that the insertion apparatus shown in FIG. 3 is of a relatively sophisticated type, particularly if it is provided with a micro-processor or a similiar control means. Switches can be assembled to printed circuit boards 18 with semi-automatic relatively simple apparatus as desired. For example, it will frequently be advantageous to provide a fixed bed for supporting the circuit board 18 and to mount the tooling actuator means 102 and the tooling 110, 112, on a movable head which is manually positioned by the operator above each site at which a switch assembly is to be mounted in the board. Assembly machines of this type can be provided with a spotlight which is focused on the location of the board at which a contact is to be mounted. Thus the operator would simply move the head until the beam of light was directed at the opening 16 of the site of the switch. The tooling would then insert a fixed contact at the particular opening positioned beneath the tooling and later a spring contact to the board.

A salient advantage of the invention is that the process of assembling springs to circuit boards is greatly facilitated and the cost of this assembling operation is thereby reduced. After the circuit board has been positioned on the plate 88 as shown in FIG. 4, it is not moved until a complete spring assembly 2 has been provided on the board. The previous practice of assembling the two parts of the spring by means of two different machines if thus avoided.

Additional benefits are derived from the fact that the switch parts are fully protected during handling and shipment after they have been mounted on the carrier strip and wound on the reel 86. Scrap losses and other losses due to mishandling of these rather fragile switch components are thereby avoided.

I claim:

1. A continuous strip containing a plurality of first switch parts and a plurality of second switch parts, said first and second switch parts being intended for assembly to circuit board means to form a circuit board switch, said strip comprising:

a continuous carrier strip having parallel side edges, said carrier strip being of a thin easily deformed material, a plurality of first openings in said strip and a plurality of second openings in said strip, said openings being spaced-apart along the length of said strip with said openings in alternating order so that a first opening is between adjacent second openings, said openings having internal edge portions which are between said parallel side edges and which define said openings, said strip having flexible internal integral cantilever arm means extending from said internal edge portions, each of said first switch parts being in one of said first openings and each of said second switch parts being in one of said second openings, said first and second switch parts each having supported portions which extend over surface portions of said cantilever arm means and are supported by said cantilever arm means whereby, said first and second parts can be assembled to circuit board means by feeding said strip to an assembly station so that the leading first switch part on said strip is at said station, locating said circuit board means adjacent to said strip, pushing said leading first switch part from said carrier strip towards said board means to assemble said leading first switch part to said board means, indexing said strip to locate the leading second switch part therein at said assembly station, pushing said leading second switch part to said board means to assemble said leading second switch part to said board means, and repeating said steps to assemble all of said first and second switch parts in said strip to said circuit board means.

2. A continuous strip as set forth in claim 1, said carrier strip comprising a polymeric material.

3. A continuous strip as set forth in claim 2, said polymeric material comprising polyethylene terephthalate.

4. A continuous strip as set forth in claim 1, each of said first parts comprising a contact button, each of said second parts comprising a contact spring.

5. A continuous strip as set forth in claim 4, each of said contact buttons comprising a button-like contact portion having a mounting stem extending centrally therefrom, each of said contact springs comprising a generally rectangular spring member having mounting stems extending in one direction from opposite ends thereof, said mounting stems extending in the same direction from one surface of said carrier strip, said mounting stems being intended for insertion through circular holes in said circuit board.

6. A continuous strip as set forth in claim 5, said strip being wound on a reel.

7. A continuous strip wound on a reel as set forth in claim 7, said strip being wound as a single spiral on said reel with said one surface facing radially outwardly with respect to the center of said reel.

8. A method of assembling sheet metal devices, having at least two parts, to a workpiece comprising the steps of:

punching holes in a continuous carrier strip of relatively thin deformable material, removably mounting and supporting marginal edge portions of a first one of said parts in alternate holes and removably mounting and supporting marginal edge portions of a second one of said parts in each of the remaining holes, feeding said carrier strip to a location adjacent to said workpiece so that the leading first part on said strip is aligned with a mounting location on said workpiece, pushing said leading first part through and from said strip and assemblying said leading first part to said workpiece, indexing said strip and positioning the leading second part on said strip in alignment with said mounting location, pushing said leading second part through and from said strip and assembling said leading second part to said workpiece, and repeating all of said steps in sequence to assemble all of said parts.

9. The method set forth in claim 8, said devices comprising switches and said workpiece comprising a circuit board, said first and second parts comprising a button contact and a spring contact respectively.

10. The method set forth in claim 9, said contacts having mounting post portions being dimensioned to be received in holes in said circuit board, said mounting post portions being pushed into said holes in said circuit board.

* * * * *